US006023819A

United States Patent [19]

Wong et al.

[11] Patent Number: 6,023,819

[45] Date of Patent: Feb. 15, 2000

[54] COIL SPRING HANGER CLIP

[75] Inventors: Eddie Wong, Hong Kong, The Hong Kong Special Administrative Region of the People's Republic of China; Jonathan Willinger, Tenafly, N.J.

[73] Assignee: Randy Hangers, L.L.C., East Rutherford, N.J.

[21] Appl. No.: 09/233,550

[22] Filed: Jan. 20, 1999

[51] Int. Cl.[7] ..... A44B 21/00

[52] U.S. Cl. ..... 24/510; 223/91; 223/96; 24/509

[58] Field of Search ..... 24/489, 499, 500, 24/509, 510, 338, 564, DIG. 29; 223/90, 91, 93, 96

[56] References Cited

U.S. PATENT DOCUMENTS

| | | | |
|---|---|---|---|
| D. 212,444 | 10/1968 | Coon | D49/1 |
| D. 296,729 | 7/1988 | Blanchard | D6/328 |
| 648,534 | 5/1900 | Seger | 223/96 |
| 928,086 | 7/1909 | Viganego | 223/91 |
| 1,795,622 | 3/1931 | Taylor et al. | 24/564 X |
| 2,376,584 | 5/1945 | Dessureau | 223/91 |
| 2,573,622 | 10/1951 | Stoneburner | 223/96 |
| 3,456,262 | 7/1969 | Coon | 24/137 |
| 3,946,915 | 3/1976 | Crane | 223/96 |
| 4,802,265 | 2/1989 | Stevenson | 223/91 X |

*Primary Examiner*—James R. Brittain
*Assistant Examiner*—Robert J. Sandy
*Attorney, Agent, or Firm*—Helfgott & Karas, PC

[57] ABSTRACT

The free ends of a coil spring are biased between a pair of jaws on a garment hanger and serve as the sole contact and connection of the spring to the jaws. A pivotable jaw pivots about a fixed jaw on a pair of stub shafts. The biasing force of the coil spring returns the pivotable jaw to a clamped position against the fixed jaw.

21 Claims, 2 Drawing Sheets

COIL SPRING HANGER CLIP

BACKGROUND OF THE INVENTION

1. Field of the Invention

The present invention relates in general to garment hangers and in particular to garment hangers having garment clips provided with spring-biased jaws driven by coil springs.

2. Description of Prior Developments

Spring-actuated garment clips have been produced in numerous configurations for securely gripping and holding a garment on a garment or clothes hanger. These clips typically employ leaf springs in various forms to bias a pair of jaws against one another.

In some cases, it is preferable to use an inexpensive spring such as a coil spring in place of a leaf spring. However, until the development of the present invention, a simple, effective and easy-to-assemble coil-spring-driven garment clip has not been available.

Accordingly, a need exists for a garment clip having a pair of jaws driven together by the biasing force provided by a simple, inexpensive coil spring.

Another need exists for a garment hanger clip having a pair of jaws interconnected with an easily assembled construction allowing for a simple wedge-fit mounting of a coil spring between the jaws.

A further need exists for such a garment clip which includes a simple yet reliable mounting structure for securely holding a coil spring in position between a pair of pivoting jaws.

SUMMARY OF THE INVENTION

The present invention has been developed to fulfill the needs noted above and therefore has as an object the provision of a garment hanger clip having a pair of garment gripping jaws biased toward each other under the force provided by a simple coil spring.

Another object of the invention is the provision a simple, inexpensive and reliable mounting structure for securely holding and positioning a coil spring in place between a pair of garment jaws without the use of fasteners.

Yet another object of the invention is the provision of a garment hanger having a fixed jaw molded on each end of the hanger arm and a movable jaw pivotally supported by the fixed jaw and the hanger arm.

These and other objects are met by the present invention which is directed to a garment hanger having a pair of coil-spring-driven garment jaws. One jaw on each clip is rigidly fixed to the arm of the garment hanger and a second jaw is pivotally mounted to the arm and to the fixed jaw. A coil spring having a pair of torsion legs is securely wedged in place between the two jaws.

The coil spring is securely held in position by elongated recesses or grooves formed in each jaw. The grooves receive and anchor the torsion legs in place while additional support structure prevents the spring from moving, except as required for driving the pivoting jaw toward the fixed jaw.

A pair of spaced-apart stub shafts is provided to allow the coil spring to seat itself centrally between the jaws and between the stub shafts. No additional contact or support is required to hold the coil spring in place, other than the contact between the torsion legs and the grooves.

The aforementioned objects, features and advantages of the invention will, in part, be pointed out with particularity, and will, in part, become obvious from the following more detailed description of the invention, taken in conjunction with the accompanying drawings, which form an integral part thereof

BRIEF DESCRIPTION OF THE DRAWINGS

In the drawings.

In the various views of the drawings, like reference numerals designate like or similar parts.

DETAILED DESCRIPTION OF THE PREFERRED EMBODIMENT

Figure 1:
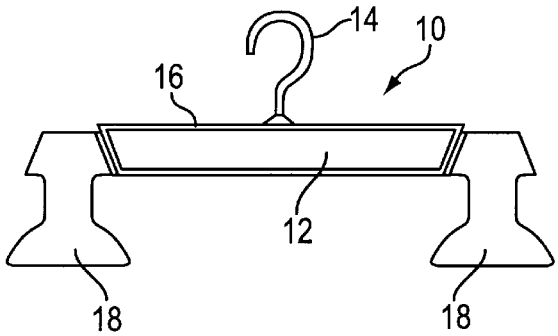
FIG. 1 is a schematic front elevation view of a garment hanger having a pair of garment clips constructed in accordance with the invention.
Figure 2:
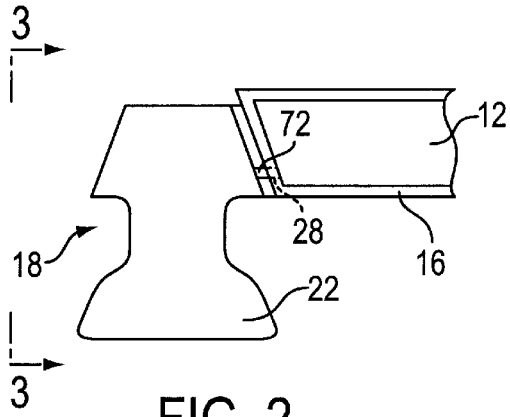
FIG. 2 is a partial front elevation view of the garment hanger of FIG. 1 showing one of the garment clips attached to the arm of the garment hanger.

The present invention will now be described in conjunction with the drawings, beginning with FIGS. 1 and 2 which show a garment hanger 10 having a hanger arm 12. A hook 14 is connected to the central top portion of the arm 12 in a known fashion. A transverse strengthening flange 16 may be formed around the outer border of the arm 12.

Figure 3:
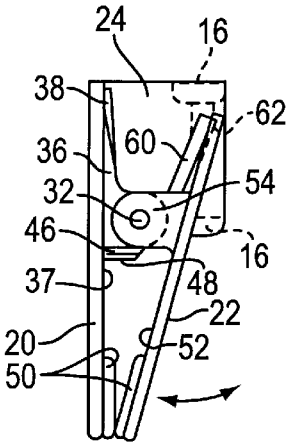
FIG. 3 is a left end view of the hanger and clip of FIG. 2 taken along line 3—3 thereof.
Figure 4:
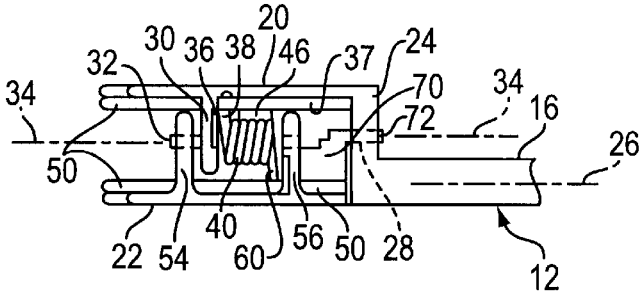
FIG. 4 is a top plan view of FIG. 2.

A pair of hanger clips 18 is provided on each free end of arm 12. As seen in FIGS. 3 and 4, each clip 18 includes a fixed jaw 20 and a movable pivoting jaw 22. Each fixed jaw 20 is connected to arm 12 by a transverse wall 24 which extends rearwardly from the longitudinal axis 26 of arm 12 at an angle of, for example, about 90 degrees.

The arm 12, flange 16, wall 24 and rear or fixed jaw 20 may all be formed as a one-piece homogeneous plastic molding. When viewed in top plan as in FIG. 4, the arm 12, wall 24 and fixed jaw 20 form a step which offsets the fixed jaw rearwardly of arm 12. A bore 28 is formed through wall 24 for providing support to the movable front jaw 22 as discussed below.

The fixed jaw 20 is formed with a forwardly extending support 30 having a cylindrical stub shaft 32 provided thereon. Stub shaft 32 extends axially along a pivot axis 34 which is aligned substantially parallel to the axis 26 of arm 12. A rib 36 extends upwardly from support 30 along the front wall 37 of the fixed rear jaw 20. Rib 36 serves as a guide for laterally guiding and laterally supporting a first leg 38 of coil spring 40, as seen in FIGS. 3 and 4.

Figure 6:
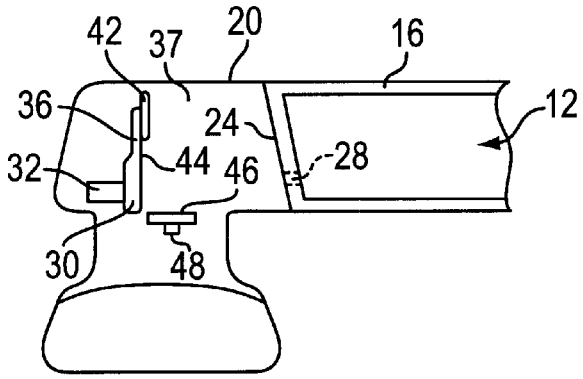
FIG. 6 is a view of FIG. 2 with the movable front jaw and coil spring removed for clarity.
Figure 7:
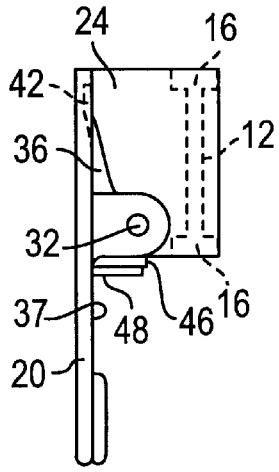
FIG. 7 is a left side view of FIG. 6.
Figure 8:
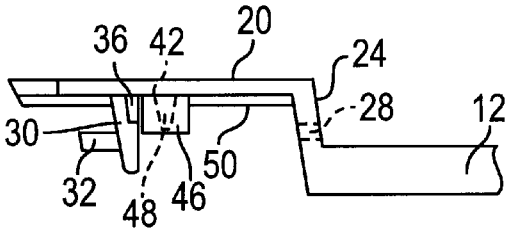
FIG. 8 is a top view of FIG. 6.

A shallow ramped groove 42 extends upwardly along the inner side 44 of rib 36 as shown in FIGS. 6, 7 and 8. Groove 42 receives the first torsion leg 38 of spring 40 and holds leg 38 in place adjacent rib 36.

An abutment in the form of a rectangular ledge 46 extends outwardly from front wall 37 adjacent the bottom of support 30 and serves as a stop to prevent spring 40 from being pressed too far downwardly during its insertion between the jaws 20, 22. A strengthening rib 48 is molded on the underside of ledge 46 for additional support.

A soft rubber pad 50 is mounted to the bottom of wall 37 of the fixed jaw 20 and to the bottom of the inner or rear wall 52 of the movable jaw 22. Pads 50 enhance the grip of the jaws around a garment such as the grip on the cuffs of a pair of pants.

Figure 9:
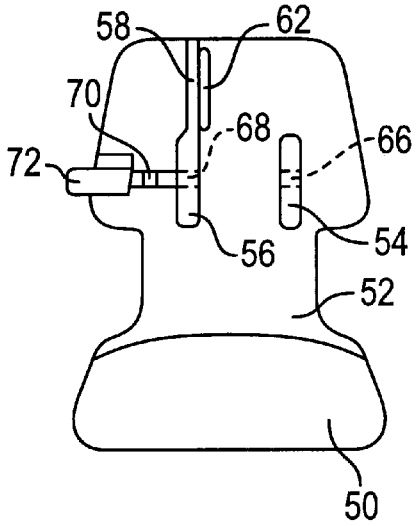
FIG. 9 is a rear view of the front movable jaw of FIG. 4.

The front pivoting jaw 22 is formed with a pair of supports 54, 56 as shown in FIGS. 4 and 9. The inner support 56 extends upwardly into a vertical rib 58 which guides and laterally supports the second leg 60 of coil spring 40 in a manner similar to the guiding support that rib 36 provides to the first leg 38 of coil spring 40.

A shallow ramped groove 62 extends along the outer face 64 of rib 58 for receiving and anchoring the second leg 60 of coil spring 40 in position. A bore 66 is formed through the outer support 54 and an optional bore 68 extends through the inner support 56.

The front pivoting jaw 22 is pivotally mounted to the arm 12 and fixed jaw 20 by inserting stub shaft 72 into bore 28 in wall 24. At the same time, stub shaft 32 on the fixed jaw 20 is inserted into bore 66 in support 54 on the pivoting jaw 22. The jaws are held in this position by inserting spring 40 into the space or pocket defined between supports 30 and 56 and ledge 46. Spring 40 can be easily manually or automatically pushed downwardly between the jaws 20, 22 and stub shafts 32, 72.

As the spring 40 is pushed downwardly and resiliently wedged between the jaws, torsion leg 38 is deflected and subsequently guided into groove 42 by rib 36 and torsion leg 60 is deflected and subsequently guided into groove 62 by rib 58. Once the first and second torsion spring legs 38, 60 are snapped into grooves 42, 62, they are held biased against the upper portions of each Jaw 20, 22 so as to push the lower portions, i.e. pads 50, into spring-biased gripping contact with one another.

Once the legs 38, 60 seat themselves in grooves 42, 62, the central coiled portion of spring 40 is held suspended between the walls 37, 52 above ledge 46. Contact between the spring 40 and jaws 20, 22 is exclusively through legs 38, 60. The seated spring 40 holds the jaws together and resists their lateral separation. In this manner, spring 40 acts as a fastener or retainer for holding the jaws together.

Figure 5:
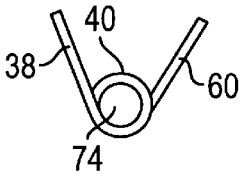
FIG. 5 is an axial end view of the spring of FIG. 4.

As seen in FIG. 5, the legs 38, 60 define a substantially V-shaped profile in axial view. The central axis 74 of the coiled portion of the spring is aligned substantially parallel with axis 26 and co-axial with pivot axis 34 about which the front jaw 22 pivots as it is opened and closed.

As the front jaw is pinched and pivoted toward the rear jaw 20, the pads 50 separate to release a garment or to receive a garment. When the jaws are released, torsional force from the coil spring is applied to the jaws via the torsion legs 38, 60 to provide a secure spring-biased grip.

There has been disclosed heretofore the best embodiment of the invention presently contemplated. However, it is to be understood that various changes and modifications may be made thereto without departing from the spirit of the invention.

What is claimed is:

1. A garment hanger clip connected to an end of a garment hanger arm, comprising:

a first jaw rigidly fixed to said arm;

a second jaw pivotally mounted to said arm and to said first jaw; and a coil spring having a central coil portion, a first free end portion biased against said first jaw and a second free end portion biased against said second jaw so as to bias said jaws against one another and wherein said coil spring is held between said first and second jaws solely by said first and second free end portions.

2. The clip of claim 1, wherein said first jaw comprises a spring seat for locating said coil portion of said coil spring between said jaws.

3. The clip of claim 1, wherein said first jaw comprises a first spring guide for locating said first free end portion of said coil spring on said first jaw.

4. The clip of claim 1, wherein said second jaw comprises a second spring guide for locating said second free end portion of said coil spring on said second jaw.

5. The clip of claim 1, wherein said first jaw comprises a first groove receiving said first free end portion of said coil spring.

6. The clip of claim 1, wherein said second jaw comprises a second groove receiving said second free end portion of said coil spring.

7. The clip of claim 1, wherein said first jaw comprises a first stub shaft pivotally supporting said second jaw.

8. The clip of claim 1, wherein said second jaw comprises a second stub shaft pivotally supporting said second jaw on said arm.

9. A garment hanger, comprising a hanger arm, a hook connected to a central portion of said hanger arm, and a garment clip provided on opposite ends of said hanger arm, each said clip comprising:

a first jaw rigidly fixed to said arm;

a second jaw pivotally mounted to said arm about a pivot axis;

a coil spring biasing said first and second jaws into clamping engagement with one another;

a first support and a second support provided on said second jaw for pivotally mounting said second jaw to said arm, said first and second supports projecting from said second jaw toward said first jaw;

a first stub shaft fixed to said first jaw and pivotally mounted on said first support; and said second support comprising a second stub shaft pivotally mounted to said arm.

10. A garment hanger, comprising a hanger arm, a hook connected to a central portion of said hanger arm, and a garment clip provided on opposite ends of said hanger arm, each said clip comprising:

a first jaw rigidly fixed to said arm;

a second jaw pivotally mounted to said arm about a pivot axis; and a coil spring comprising a first leg and a second leg each respectively biasing said first and second jaws into clamping engagement with one another and wherein said coil spring engages said clip exclusively with said first and second legs.

11. The hanger of claim 10, wherein said coil spring comprises a central axis aligned substantially parallel to said pivot axis.

12. The hanger of claim 11, wherein said arm comprises a longitudinal axis and wherein said central axis of said coil spring is aligned substantially parallel to said longitudinal axis.

13. The hanger of claim 10, wherein said first and second legs define a V-shaped axial profile.

14. The hanger of claim 10, further comprising a first support and a second support provided on said second jaw for pivotally mounting said second jaw to said arm, said first and second supports projecting from said second jaw toward said first jaw.

15. The hanger of claim 14, wherein said coil spring is disposed between said first and second supports.

16. The hanger of claim 14, wherein said first jaw has a first stub shaft fixed thereto, and wherein said first stub shaft is pivotally mounted on said first support.

17. The hanger of claim 16, wherein said second support comprises a second stub shaft pivotally mounted to said arm.

18. The hanger of claim 17, further comprising a strengthening rib interconnecting said second support and said second stub shaft.

19. A garment hanger, comprising:

a hanger arm having opposite ends;

a hook provided on said hanger arm;

a garment clip having a pair of jaws provided on each of said opposite ends of said hanger arm; and a pair of stub shafts providing a pivoting connection between each of said pair of jaws on said respective opposite end portions.

20. The hanger of claim 19, further comprising a spring located between each of said pair of jaws.

21. The hanger of claim 20, wherein said spring comprises a coil spring.

* * * * *